US006723188B2

(12) United States Patent
Shimosato et al.

(10) Patent No.: US 6,723,188 B2
(45) Date of Patent: Apr. 20, 2004

(54) STEEL WORKPIECE OIL QUENCHING METHOD

(75) Inventors: Yoshikazu Shimosato, Osaka (JP); Saburo Ogawa, Osaka (JP); Kiyohiro Miyamoto, Osaka (JP)

(73) Assignee: Chugai Ro Co., Ltd, Osaka (JP)

( * ) Notice: Subject to any disclaimer, the term of this patent is extended or adjusted under 35 U.S.C. 154(b) by 204 days.

(21) Appl. No.: 10/067,202

(22) Filed: Feb. 7, 2002

(65) Prior Publication Data

US 2002/0166610 A1 Nov. 14, 2002

(30) Foreign Application Priority Data

Feb. 8, 2001 (JP) ..... 2001-032244

(51) Int. Cl.[7] ..... C21D 1/18; C21D 1/58

(52) U.S. Cl. ..... 148/637; 148/660

(58) Field of Search ..... 148/660, 637

(56) References Cited

FOREIGN PATENT DOCUMENTS

JP 2-101113 A 4/1990
JP 6-279838 A 10/1994

*Primary Examiner*—Deborah Yee
(74) *Attorney, Agent, or Firm*—Birch, Stewart, Kolasch & Birch, LLP

(57) ABSTRACT

A steel workpiece maintained at a specified quenching temperature is rapidly cooled to a temperature just above the martensite transformation start point (Ms point) by being immersed in a high-temperature quenching oil. Thereafter, the steel workpiece is taken out of the high-temperature quenching oil so as to be soaked by the heat possessed by the steel workpiece and subsequently cooled by being immersed in the high-temperature quenching oil. Through these processes, a temperature difference between steel workpieces or the portions of a steel workpiece in the martensite transformation stage is reduced, and a cooling speed in a high-temperature region (not lower than about 550° C.) is made to be a slow speed sufficient for restraining a thermal distortion, by which the quenching distortion and quenching variation can be reduced.

8 Claims, 3 Drawing Sheets

STEEL WORKPIECE OIL QUENCHING METHOD

This nonprovisional application claims priority under 35 U.S.C. § 119(*a*) on Patent Application No. 2001-32244 filed in Japan on Feb. 8, 2001, which is herein incorporated by reference.

BACKGROUND OF THE INVENTION

The present invention relates to a steel workpiece oil quenching method and, in particular, to a method for processing a steel workpiece in a marquenching manner.

In general, when a steel workpiece maintained at a quenching temperature is immersed in quenching oil, the steel workpiece is cooled through the three stages of a vapor film stage (high-temperature region), a boiling stage (intermediate-temperature region) and a convection stage (low-temperature region). It is known that a cooling speed in the vapor film stage is slow and a cooling speed in the boiling stage is three to ten times faster than the above-mentioned speed. A high-temperature quenching oil (hot quenching oil), of which the cooling speed in the intermediate-temperature and low-temperature regions is slower than that of a low-temperature quenching oil (cold quenching oil), is therefore able to reduce the distortion attributed to a quenching transformation. However, it is also known that a thermal distortion attributed to a temperature difference in the high-temperature region tends to easily occur since the time of the vapor film stage is short and the end temperature in the vapor film stage is high. If the quenching oil is put in a reduced pressure state, as shown in FIG. 2, the time of the vapor film stage is prolonged by the reduction of the boiling point, and the end temperature in the vapor film stage is lowered. Accordingly, as a method for reducing the deformation attributed to the quenching taking advantage of the above-mentioned phenomenon, there has been put in practice a method for performing quenching by immersing a steel workpiece maintained at a quenching temperature in a high-temperature quenching oil or a method for performing quenching by immersing the steel workpiece in a quenching oil under a reduced pressure.

On the other hand, as an oil quenching method of a steel workpiece such as a gear, there is a method (marquenching method) for rapidly cooling a steel workpiece maintained at a specified quenching temperature to a temperature slightly higher than the martensite transformation start point (Ms point) by immersing the steel workpiece in a high-temperature coolant at a temperature slightly higher than the martensite transformation start point (Ms point), thereafter cooling the steel workpiece in the atmospheric air by taking out the steel workpiece out of the high-temperature coolant at a point of time when the entire steel workpiece comes to have roughly same temperature, and thereby effecting the martensite transformation. This method, which can reduce the quenching distortion and the quenching variation, has the problem that the cooling speed causes a temperature difference between the placement positions of workpieces in a tray and between the portions of a workpiece due to the cooling in the atmospheric air, and consequently the quenching distortion and the quenching variation attributed to the temperature difference cannot be avoided.

As a method for solving this problem, there has been proposed a method for rapidly cooling a steel workpiece maintained at a specified temperature by immersing the steel workpiece in a high-temperature coolant at a temperature higher than the martensite transformation start temperature and thereafter immersing the steel workpiece in a low-temperature coolant at a temperature lower than the martensite transformation start temperature at the point of time when the entire steel workpiece comes to have roughly same temperature (as described in Japanese Patent Laid-Open Publication No. 2-101113), a method for providing a circulation system for circulating a quenching oil, using a quenching bath that has a hood for surrounding the workpiece, immersing the workpiece inside the hood in a state in which the circulation system is stopped, raising the temperature of the quenching oil inside the hood close to the martensite transformation start temperature (Ms point) by the heat of the workpiece, and then rapidly cooling the workpiece to a temperature lower than the martensite transformation start temperature by circulating the quenching oil in the circulation system at the point of time when the entire workpiece has roughly same temperature (as described in Japanese Patent Laid-Open Publication No. 6-279838) or the like.

However, from the viewpoint of the construction and structure of the quenching apparatus, the former method, which needs not only the high-temperature coolant and the low-temperature coolant but also the quenching bath for the high-temperature coolant and the quenching bath for the low-temperature coolant, has the problem that the quenching apparatus becomes inevitably increased in size and complicated and has poor maintenance. The latter method, which solves the problem of the former method, has the problem that the quenching bath itself is complicated. Moreover, from the viewpoint of quenching distortion and variation, both are the systems for putting the entire steel workpiece into roughly same temperature by immersing the steel workpiece in the coolant, and therefore, it is difficult to bring the coolant that serves as a thermal medium in contact with all workpieces on the tray or the entire portions of the workpiece uniformly and sufficiently, and consequently a temperature difference occurs between the steel workpieces or the portions of the steel workpiece in the soaking stage. Accordingly, although those methods have the effect of reducing the quenching distortion and variation, the effect are not satisfactory.

As a result of detailed researches for solving the aforementioned problems, it was discovered that these quenching distortion and variation were attributed to the temperature difference between the steel workpieces or the portions of the steel workpiece during the martensite transformation and to the fact that the cooling speed in the high-temperature region (not lower than about 550° C.) was too fast.

SUMMARY OF THE INVENTION

Accordingly, the present invention has the object of reducing the temperature difference between steel workpieces or the portions of a steel workpiece in the martensite transformation stage and making the cooling speed in a high-temperature region (not lower than about 550° C.) a slow speed sufficient for restraining the thermal distortion, thereby reducing the quenching distortion and quenching variation.

In order to achieve the aforementioned object, a steel workpiece oil quenching method of the present invention comprises the steps of: rapidly cooling a steel workpiece maintained at a specified quenching temperature by immersing the steel workpiece in a high-temperature quenching oil until a temperature of a specified portion of the steel workpiece reaches a temperature just above a martensite transformation start point (Ms point); thereafter taking the steel workpiece out of the high-temperature quenching oil to soak the steel workpiece by heat possessed by the steel workpiece; and cooling the steel workpiece by subsequently immersing the steel workpiece in the high-temperature quenching oil.

According to one embodiment of the present invention, the steel workpiece is rapidly cooled in a rapid cooling process until a temperature of its portion producing the largest deformation amount (in the concrete, a portion having a small internal volume with respect to a unit area of the steel workpiece (for example, a gear tooth, a corner portion of a prismatic workpiece, or the like, hereinafter referred to as "a sharp portion")) reaches a temperature just above the Ms point of the portion.

The present invention is based on the following knowledge. That is, according to the method of the present invention, the steel workpiece is first cooled to a temperature just above the martensite transformation start point (Ms point) by being immersed in the high-temperature quenching oil. In this case, it is proper to take the steel workpiece out of the high-temperature quenching oil at the point of time when the entire steel workpiece is cooled to a temperature just above the aforementioned Ms point. However, the practical steel workpiece is generally subjected to a carburizing process immediately before being quenched. Therefore, the concentration of carbon dispersed inside the steel workpiece is not uniform throughout the entire steel workpiece, and the Ms point is sometimes varied with portions. For example, in a sharp portion of a steel workpiece, the carbon concentration in its surface portion becomes higher than that of a portion (for example, a portion that is not carburized inside the steel workpiece, i.e., a non-carburized portion) other than the sharp portion. Therefore, the Ms point ($Ms_2$) of the surface portion of the sharp portion becomes lower than the Ms point ($Ms_1$) of the non-carburized portion, and there consequently occurs a variation in the amount of deformation. However, the portion that belongs to the steel workpiece and is other than the sharp portion, i.e., the non-carburized portion generally has little deformation even when being quenched. Even if the temperature of the non-carburized portion becomes just below the Ms point ($Ms_1$) of the portion, the characteristics of the steel workpiece receive little bad influence. When the temperature of the sharp portion producing the largest deformation amount is just above the Ms point ($Ms_2$) of the portion, the variation in the amount of deformation of the entire steel workpiece can be reduced by soaking. The present invention is based on such knowledge.

For the aforementioned quenching oil, of which the type, temperature and quantity are set according to the workpiece, there is normally adopted a high-temperature quenching oil corresponding to No. 1 or 2 of Type 2 of JIS K2242. Moreover, the temperature of the quenching oil is set within a range of 100 to 170° C. It is proper to set the quantity of the quenching oil to a value at which the aforementioned setting temperature is not largely varied by primary quenching.

Moreover, after the rapid cooling, the steel workpiece is retained in an upper space located above the quenching oil inside the oil quenching chamber in order to thermally uniform or soak the workpiece. The atmospheric temperature of the upper space is normally roughly equal to the temperature of the high-temperature quenching oil. It is difficult to uniquely determine the time during which the workpiece obtained through the primary quenching is soaked by the heat possessed by the workpiece itself in the upper space of the oil quenching chamber until the workpiece comes to have a temperature just above the martensite transformation start point (Ms point) because the time is varied depending on the size, material and so on of the workpiece. The time is normally set to 30 to 300 seconds.

A temperature difference ascribed to the placement position of the workpiece in the tray and a temperature difference between the portions of a workpiece can further be reduced by the so-called marquenching process for immersing again the workpiece in the high-temperature quenching oil after the soaking.

According to one embodiment of the present invention, the internal pressure in the oil quenching chamber during the quenching is set to 7 to 75 KPa or, more preferably, to 8 to 40 KPa. This is because the vapor film stage in a vacuum higher than 7 KPa becomes too long to obtain a sufficient quenching hardness and a sufficient depressurizing effect cannot be obtained, failing in restraining the thermal distortion, in a vacuum lower than 75 KPa.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENT

Figure 1:
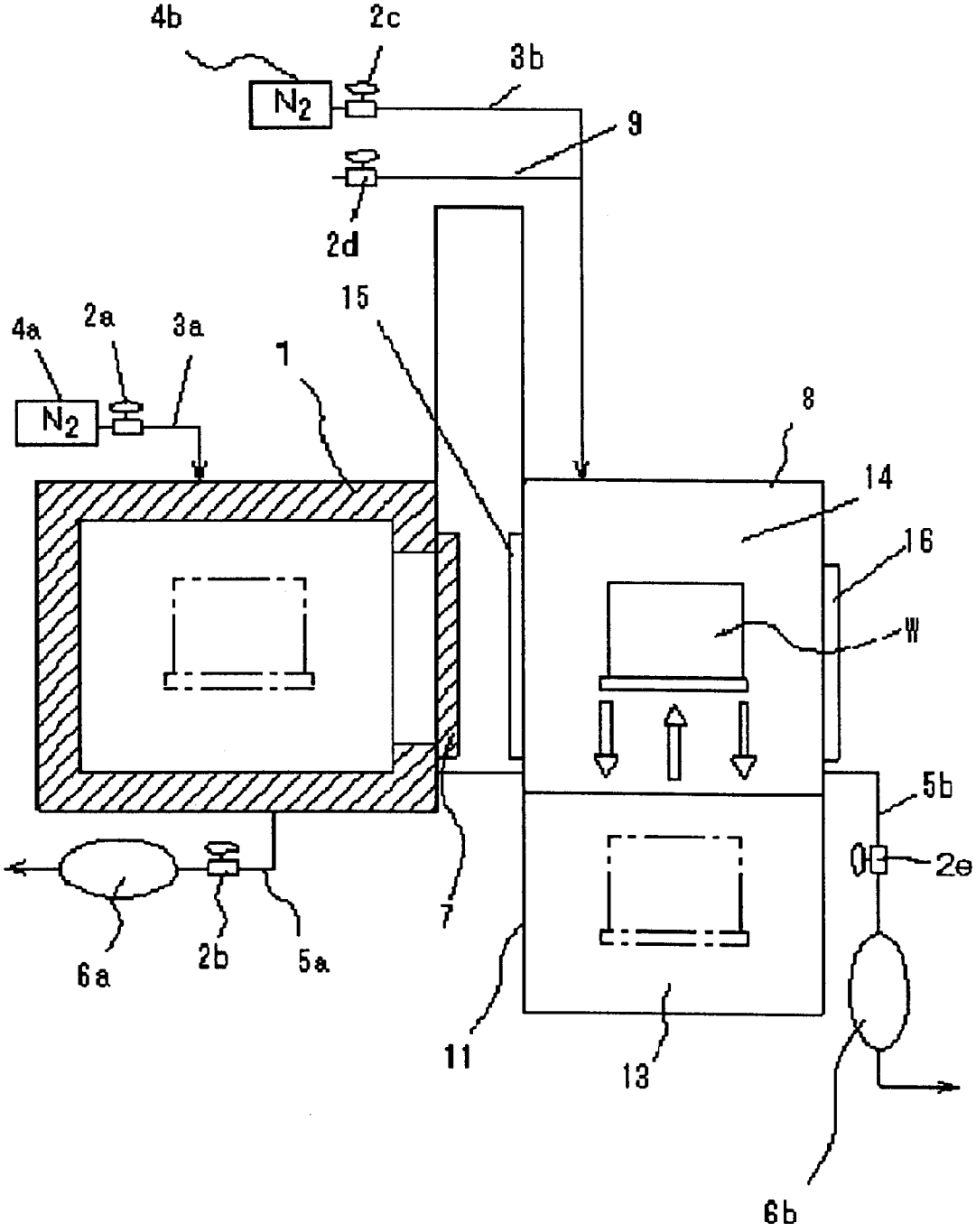
FIG. 1 is an explanatory view showing the structure of a carburizing furnace to be used for implementing the method of the present invention.
Figure 2:
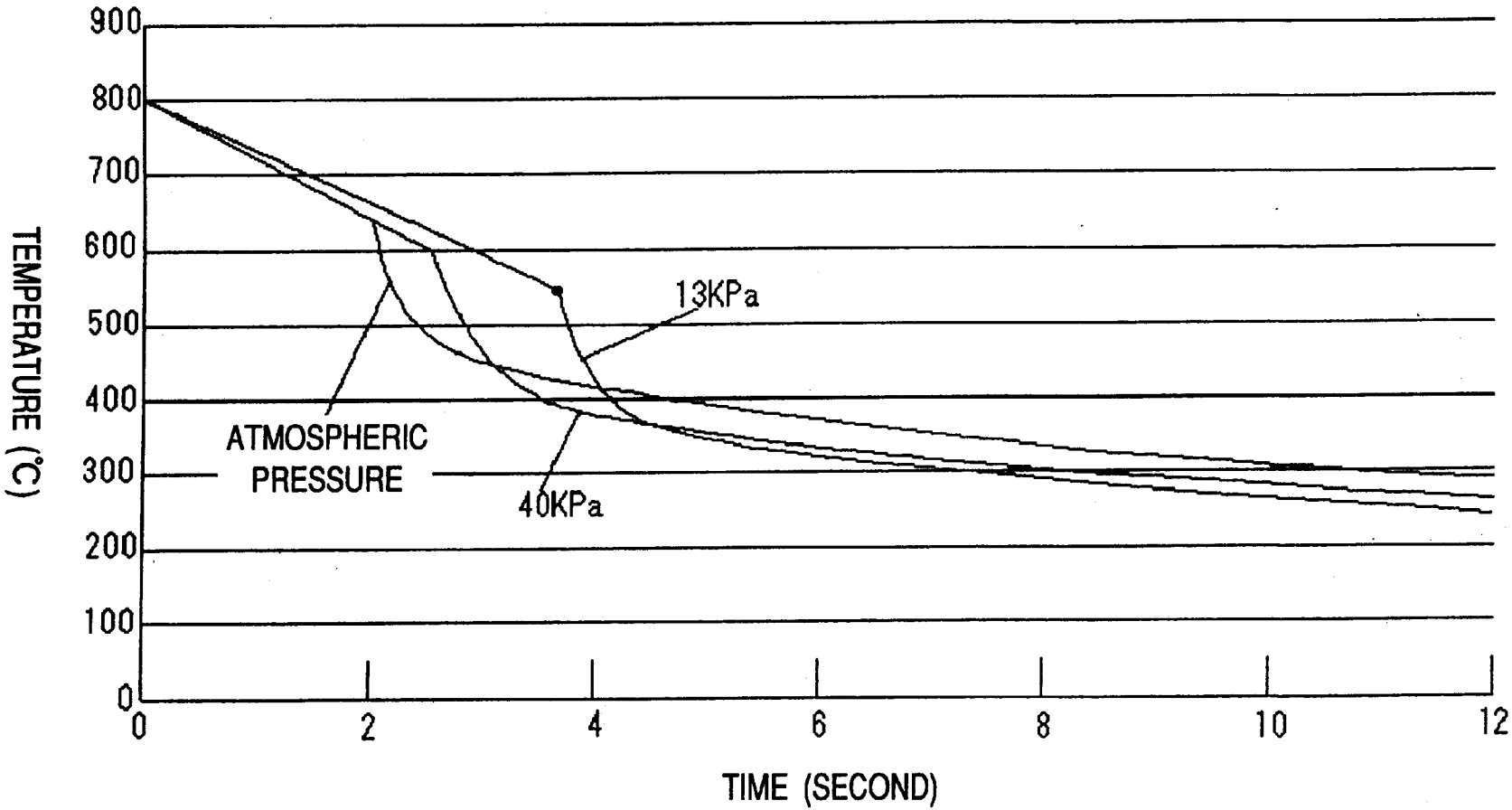
FIG. 2 is a graph showing the cooling curves of a steel workpiece under various atmospheric pressures.

FIG. 1 shows the structure of a batch type carburizing furnace to be used for implementing the method of the present invention, where the furnace is constructed of a heating chamber 1 and an oil quenching chamber 8. The heating chamber 1 is connected to a nitrogen gas supply source 4*a* via a nitrogen supply line 3*a* provided with a valve 2*a*, a vacuum pump 6*a* via an exhaust line 5*a* provided with a valve 2*b*, and a carburizing gas supply line (not shown). The heating chamber 1 is connected to the oil quenching chamber 8 with interposition of a heating chamber door 7.

The oil quenching chamber 8 is connected to a nitrogen gas supply source 4*b* via a nitrogen supply line 3*b* provided with a valve 2*c*, made to communicate with the atmosphere via an air supply line 9 provided with a valve 2*d* and connected to a vacuum pump 6*b* via an exhaust line 5*b* provided with a valve 2*e*. The oil quenching chamber 8 has therein a quenching oil bath 11 and is provided with elevating means (not shown) for immersing and retaining a workpiece W in the quenching oil and retaining the workpiece in an upper space 14 located above the quenching oil bath 11 by moving up and down the workpiece. An intermediate door 15 and a loading and unloading door 16 are installed on the heating chamber 1 side and the atmosphere side, respectively.

When implementing the method of the present invention, first of all, the heating chamber 1 and the oil quenching chamber 8 are vacuumed to a prescribed degree of vacuum within a range of about 7 to 75 KPa. After both the chambers reach the prescribed degree of vacuum, the primary quenching is performed by transporting the workpiece W from the heating chamber 1 into the oil quenching chamber 8 and rapidly cooling the workpiece until the surface of the workpiece W comes to have a temperature just above the martensite transformation start point (Ms point) while immersing the workpiece in a high-temperature quenching oil 13. At this time, the quenching oil 13 is a high-temperature quenching oil, and the workpiece is cooled while being immersed into the quenching oil 13 in a state in which the internal pressure of the oil quenching chamber 8 is reduced. Therefore, the cooling speed in the vapor film stage is slower than that of the quenching with the high-temperature quenching oil under the atmospheric pressure, and the cooling time in the vapor film stage becomes long. As a result, the workpiece W is cooled slowly and uniformly in the high-temperature region (850 to 550° C.).

Subsequently, at the point of time when the surface of a portion (for example, the sharp portion of the workpiece), whose distortion would fall out of the permissible range if the quenching is still continued, reaches a temperature just above a surface martensite transformation start point ($Ms_2$ point), the workpiece W is taken out of the high-temperature quenching oil 13 and exposed in the upper space 14 inside the oil quenching chamber 8 so as to be soaked until the surface and the inside of the workpiece W come to have a temperature just above the surface martensite transformation start point ($Ms_2$ point).

Further, after the soaking, the secondary quenching is performed by immersing again the workpiece W in the high-temperature quenching oil 13 for cooling. In this stage, the workpiece W, which has undergone the soaking process and immersed in the high-temperature quenching oil, can be cooled more uniformly than when air cooling is performed. Therefore, the martensite transformation is uniformly achieved by the marquenching process. Moreover, the high-temperature quenching oil has a slow cooling speed in the cool temperature region than that of a low-temperature quenching oil, and therefore, the workpiece W can be cooled more uniformly.

When the cooling is completed, the workpiece W is taken out of the high-temperature quenching oil 13. After restoring the atmospheric pressure by introducing air from the air supply line 9 into the oil quenching chamber 8 with the valve 2*d* opened, the workpiece is taken out of the furnace through the loading and unloading door 16 from the oil quenching chamber 8.

The workpiece W has different temperature histories at its different portions, and the martensite transformation start point (Ms point) at each of the portions is also varied according to the carbon concentration (C %). This relation between the carbon concentration and the martensite transformation start point (Ms point) is given by, for example, the following well-known expression:

$$Ms(^\circ C.)=550-361(\%C)-39(\%Mn)-35(\%Cr)-17(\%Ni)-10(\%Cu)-5(\%Mo+\%W)+15(\%Co)+30(\%Al).$$

Figure 3:
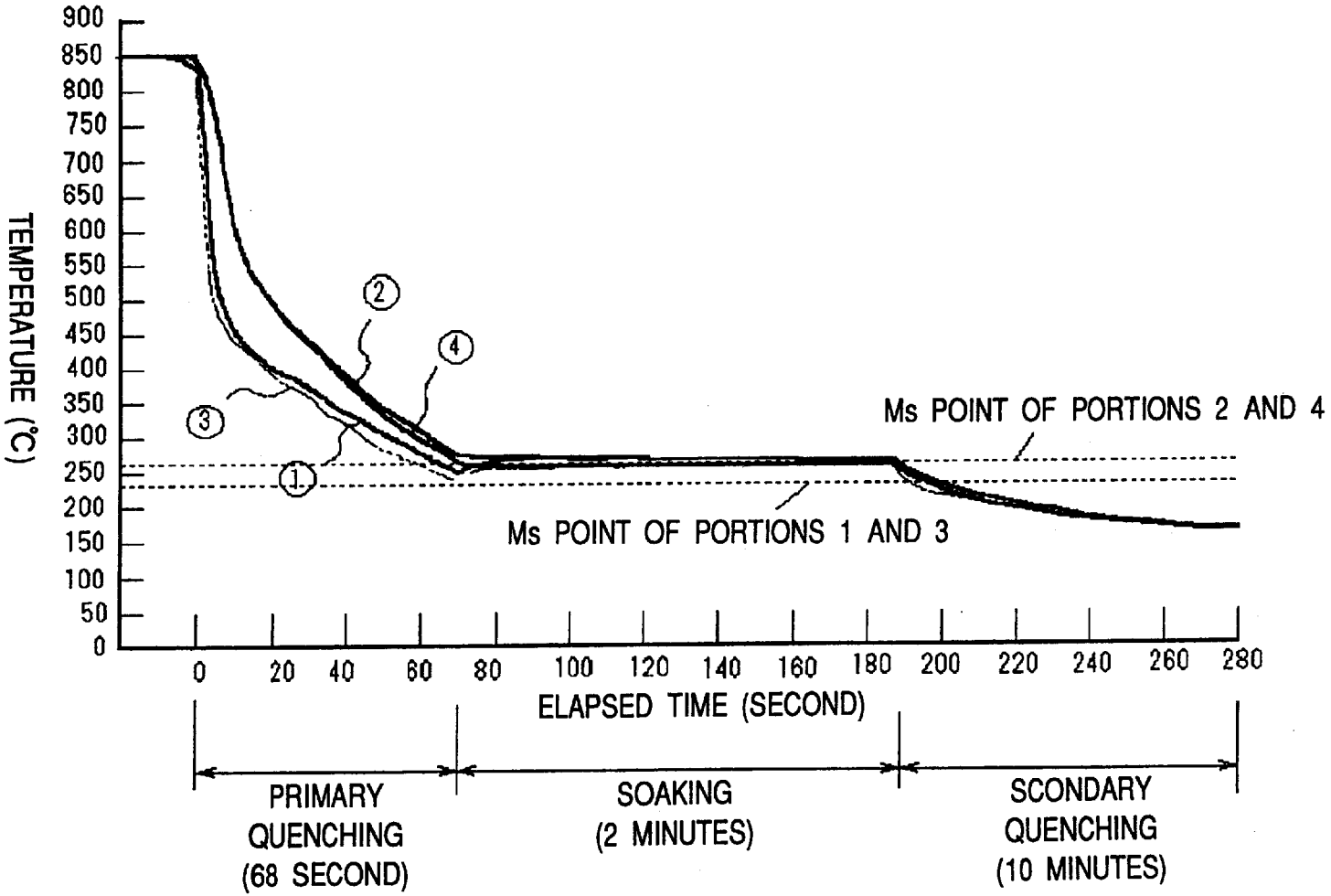
FIG. 3 is a graph showing the cooling curves of the portions of a steel workpiece.

Therefore, the present invention is made most effective by taking the workpiece W out of the high-temperature quenching oil 13 when all the portions of the workpiece reach a temperature just above the martensite transformation start point (Ms point) obtained according to the aforementioned equation. However, although only four points are shown in FIG. 3, it is practically impossible to obtain at every point the temperature transition in the primary quenching stage and the martensite transformation start point (Ms point) which are varied with the portions of the workpiece W and take out the workpiece at a temperature just above the martensite transformation start point (Ms point). Accordingly, in the present invention, the workpiece is taken out of the high-temperature quenching oil 13 when the temperature of the sharp portion, which is the portion of the largest amount of deformation, reaches a temperature just above the Ms point ($Ms_2$) of the portion. This is for the reason that the variation in the amount of deformation of the entire steel workpiece can be reduced by soaking so long as the temperature of the sharp portion, which is the portion of the largest amount of deformation, is just above the Ms point ($Ms_2$) of the portion even if the temperature of the surface portion of the portion of a small amount of deformation becomes a temperature just below the Ms point ($M_1$) of the portion in the case of the normal quenching.

It is to be noted that the point of time when the portion (in the concrete, the portion that necessitates the surface quenching of the steel workpiece), whose distortion would fall out of the permissible range if the quenching is still continued, reaches a temperature just above the surface martensite transformation start point ($Ms_2$ point), i.e., the timing of taking the workpiece W out of the high-temperature quenching oil 13 is controlled by the immersing time. Moreover, the point of time when the surface and the inside of the workpiece W that has undergone the primary quenching reaches a temperature just above the martensite transformation start point ($Ms_2$ point), i.e., the timing of immersing the workpiece again in the high-temperature quenching oil 13 is controlled by the exposure time of the workpiece in the upper space 14 of the oil quenching chamber 8.

Although the aforementioned embodiment has been described taking the case of the oil quenching chamber 8 put in the state of a reduced pressure as an example, it is also acceptable to perform the processing with the oil quenching chamber 8 put in the atmospheric pressure state. In this case, by performing the soaking process with the workpiece pulled out of the quenching oil after the primary quenching, the martensite transformation can uniformly be achieved in the subsequent secondary quenching stage. This method therefore has a satisfactory effect of reducing the variation in distortion. Furthermore, since the cooling of the workpiece W in the high-temperature region can uniformly be achieved in the reduced pressure state, a further effect of reducing the variation in distortion can be obtained.

IMPLEMENTAL EXAMPLE 1

Forty workpieces of final gears (material: SCM420H, 180 mm in diameter) for automobile transmission use loaded as a workpiece W on a tray were subjected to a carburizing process (effective carburizing depth: 0.7 mm) at a carburizing temperature of 950° C. in the heating chamber 1. Thereafter, the workpieces were transported into the oil quenching chamber 8 and subjected to the quenching process under the following conditions. The cooling curves of the actual measurement values in this case are shown in FIG. 3, in which the mark ① indicates a cogged portion in an upper portion of the workpiece, the mark ② indicates a thick portion in the upper portion of the workpiece, the mark ③ indicates a cogged portion in a lower portion of the workpiece, the mark ④ indicates a thick portion in the lower portion of the workpiece.

Quenching Conditions:

- Quenching Start Temperature: 850° C.
- Quenching Oil Temperature: 120° C.
- Internal Pressure of Oil Quenching Chamber 8: Atmospheric Pressure
- Primary Quenching (Immersing Time): 68 seconds
- Soaking (Exposure Time): 2 minutes
- Secondary Quenching (Immersing Time): 7 minutes

COMPARATIVE EXAMPLE 1

Final gears (material: SCM420H, 180 mm in diameter) for automobile transmission use were adopted as a workpiece W and subjected to a quenching process under the same conditions as those of the implemental example 1 except that the soaking process was eliminated and continuous immersing was adopted, as described hereinbelow.

Quenching Conditions:

Quenching Start Temperature: 850° C.

Quenching Oil Temperature: 120° C.

Internal Pressure of Oil Quenching Chamber 8: Atmospheric Pressure

Quenching (Immersing Time): 10 minutes

The results of comparison of the variations in the deformation amount of the cog shape and the cog striation of the workpieces obtained by the implemental example 1 and the comparative example 1 were as follows. These results indicate that the variation in the deformation amount is reduced by the restrained thermal distortion as a consequence of the reduced temperature difference between the steel workpieces or the portions of a steel workpiece in the martensite transformation stage and the slow cooling speed in the high-temperature region (not lower than about 550° C.) in the case of the workpiece that has undergone the oil quenching according to the method of the present invention.

| | Implemental Example 1 | Comparative Example 1 |
|---|---|---|
| Variation in Deformation Amount of Cog Shape | 1.1 | 1.5 |
| Variation in Deformation Amount of Cog Striation | 0.9 | 1.2 |

IMPLEMENTAL EXAMPLE 2

Thirty-two workpieces of hypoid gears (material: SCr420H, 200 mm in diameter) for automobile transmission use loaded as a workpiece W on a tray were subjected to a carburizing process (effective carburizing depth: 0.9 mm) at a carburizing temperature of 950° C. in the heating chamber 1. Thereafter, the workpieces were transported into the oil quenching chamber 8 and subjected to the quenching process under the following conditions.

Quenching Conditions:

Quenching Start Temperature: 850° C.

Quenching Oil Temperature: 120° C.

Internal Pressure of Oil Quenching Chamber 8: 13 KPa

Primary Quenching (Immersing Time): 58 seconds

Soaking (Exposure Time): 2 minutes

Secondary Quenching (Immersing Time): 10 minutes

COMPARATIVE EXAMPLE 2

Hypoid gears (material: SCr420H, 200 mm in diameter) for automobile transmission use were adopted as a workpiece W and subjected to a quenching process under the same conditions as those of the implemental example 2 except that the quenching was press quenching.

Quenching Conditions:

Quenching Start Temperature: 850° C.

Quenching Oil Temperature: 120° C.

Internal Pressure of Oil Quenching Chamber 8: Atmospheric Pressure

Quenching (Corrective Die Quenching)

Quenching (Immersing Time): 10 minutes

The results of comparison of the variations in the deformation amount of the cog shape and the cog striation of the workpieces obtained by the implemental example 2 and the comparative example 2 were as follows.

| | Implemental Example 2 | Comparative Example 2 |
|---|---|---|
| Variation in Flatness | 2.0 | 2.0 |
| Variation in Deformation Amount of Cog Shape | 2.0 | 2.5 |
| Variation in Deformation Amount of Cog Striation | 6.5 | 9.0 |

These results indicate that the variation in the deformation amount is reduced by the restrained thermal distortion as a consequence of the reduced temperature difference between the steel workpieces or the portions of a steel workpiece in the martensite transformation stage and the slow cooling speed in the high-temperature region (not lower than about 550° C.) in the case of the workpiece that has undergone the oil quenching according to the method of the present invention.

Although the aforementioned implemental examples and the comparative examples take the quenching process of the steel workpiece subjected to the carburizing process as an example, the method of the present invention can also be applied to the quenching process of tool steels, bearing steels or steels for machine structural use. The number of quenching baths is not limited to one, and there may be two quenching baths.

As described above, the method of the present invention, which performs the primary quenching by means of the high-temperature quenching oil, is able to perform the cooling in the high-temperature region at a slow speed, thereby restraining the thermal distortion in the high-temperature region. In addition, the method of the present invention, in which the steel workpiece is once taken out of the high-temperature quenching oil at a temperature just above the Ms point so as to be soaked by the heat possessed by the workpiece itself, and thereafter the workpiece is immersed again in the high-temperature quenching oil so as to be cooled, can reduce the temperature difference between the steel workpieces or the portions of a steel workpiece in the martensite transformation stage, thereby reducing the variation in quenching distortion. Moreover, the method of the present invention, which performs the quenching by reducing the internal pressure of the oil quenching chamber, is able to perform cooling in the intermediate-temperature region somewhat rapidly. This compensates for a shortage in cooling ability due to pressure reduction and enables the prevention of an increase in the quenching time. Furthermore, the marquenching process can be achieved with one quenching bath, and the oil quenching chamber is allowed to have a simple structure.

Although the present invention has been fully described by way of the example with reference to the accompanying drawings, it is to be noted that various changes and modifications will be apparent to those skilled in the art. Therefore, unless such changes and modifications otherwise depart from the spirit and scope of the present invention, they should be construed as being included therein.

What is claimed is:

1. A steel workpiece oil quenching method comprising the steps of: rapidly cooling a steel workpiece maintained at a specified quenching temperature by immersing the steel workpiece in a high-temperature quenching oil until a specified portion of the steel workpiece reaches a temperature just above a martensite transformation start point (Ms point); thereafter taking the steel workpiece out of the high-temperature quenching oil to soak the steel workpiece by heat possessed by the steel workpiece; and cooling the steel workpiece by subsequently immersing the steel workpiece in the high-temperature quenching oil.

2. The steel workpiece oil quenching method as claimed in claim 1, wherein the specified portion of the steel workpiece is a portion that belongs to the steel workpiece and has a largest amount of deformation.

3. The steel workpiece oil quenching method as claimed in claim 1, wherein a pressure inside an oil quenching chamber during quenching is 7 KPa to 75 KPa.

4. The steel workpiece oil quenching method as claimed in claim 1, wherein an internal pressure of an oil quenching chamber during quenching is an atmospheric pressure.

5. The steel workpiece oil quenching method as claimed in claim 1, wherein the high-temperature quenching oil has a temperature of 100 to 170° C.

6. The steel workpiece oil quenching method as claimed in claim 1 or 5, wherein an atmospheric temperature of a space in which the steel workpiece is retained during soaking is roughly equal to the temperature of the high-temperature quenching oil.

7. The steel workpiece oil quenching method as claimed in claim 1, wherein a timing of taking the steel workpiece out of the high-temperature quenching oil for soaking is controlled by a time during which the steel workpiece is immersed in the high-temperature quenching oil.

8. The steel workpiece oil quenching method as claimed in claim 1, wherein a timing of immersing the steel workpiece again in the high-temperature quenching oil is controlled by a time during which the steel workpiece is exposed in a space located above the oil quenching chamber.

* * * * *